US007690590B2

(12) United States Patent
Nelson et al.

(10) Patent No.: US 7,690,590 B2
(45) Date of Patent: Apr. 6, 2010

(54) ELECTRONICALLY CONTROLLED JOURNAL LOADING SYSTEM

(75) Inventors: Walter A. Nelson, Tinley Park, IL (US); David C. Wasz, Clarendon Hills, IL (US)

(73) Assignee: ALSTOM Technology Ltd, Baden (CH)

( * ) Notice: Subject to any disclaimer, the term of this patent is extended or adjusted under 35 U.S.C. 154(b) by 0 days.

(21) Appl. No.: 12/138,460

(22) Filed: Jun. 13, 2008

(65) Prior Publication Data

US 2009/0308961 A1 Dec. 17, 2009

(51) Int. Cl.
*B02C 15/00* (2006.01)

(52) U.S. Cl. ..... 241/30; 241/121

(58) Field of Classification Search ..... 241/117–121, 241/30, 37

See application file for complete search history.

(56) References Cited

U.S. PATENT DOCUMENTS

| | | | |
|---|---|---|---|
| 3,465,971 | A | 9/1969 | Dalenberg et al. |
| 3,881,348 | A | 5/1975 | Morton |
| 4,002,299 | A | 1/1977 | Skalka |
| 4,234,132 | A | 11/1980 | Maliszewski |
| 4,372,496 | A | 2/1983 | Maliszewski |
| 4,706,900 | A | 11/1987 | Prairie et al. |
| 4,754,931 | A | 7/1988 | Shulof et al. |
| 7,182,283 | B1 | 2/2007 | Santucci |

FOREIGN PATENT DOCUMENTS

| | | | |
|---|---|---|---|
| DE | 3031647 | * | 3/1982 |
| JP | 5-104011 | * | 4/1993 |

OTHER PUBLICATIONS

PCT International Search Report and the Written Opinion of the International Searching Authority dated Nov. 16, 2009 - (PCT/US2009/046539).

* cited by examiner

*Primary Examiner*—Mark Rosenbaum
(74) *Attorney, Agent, or Firm*—Lawrence P. Zale

(57) ABSTRACT

An electronically controlled journal loading system 20 for controlling and adjusting the amplitude of the load applied to a journal assembly 19 of a pulverizing mill 10. The journal loading system 20 includes a servomotor 44, resolver 134, vertical gearbox 42, coil spring assembly 40, controller 46 and a user interface 48. The journal loading system 20 provides electronic control and adjustment of the force applied to the journal assembly 19 to thereby increase or decrease the load that a grinding roll 18 imposes on the material being pulverized. In the mode of operation of the servo journal loading system 20, a desired load set point is selected via the user/operator interface 48. The servomotor 44 rotates a preload stud (or servo screw) 50 within the coiled spring assembly 40 in the appropriate direction via the gearbox 42. As the preload stud 50 turns, a bronze nut 100 and bushing 94 move axially along the stud to compress or decompress the spring 86. Based upon the linear movement of the preload stud 50 and the precalculated spring force of the spring 86, the load applied to the journal assembly 19 is displayed on the operator interface 48. Once the journal loading level is achieved the servomotor 44 can be turned off since the spring assembly 40 maintains the selected loading to the journal assembly 19.

20 Claims, 2 Drawing Sheets

ELECTRONICALLY CONTROLLED JOURNAL LOADING SYSTEM

TECHNICAL FIELD

The present invention relates to a journal assembly for a pulverizer, and more particularly, to an electronically controlled journal loading system of a mill for pulverizing material, such as a solid fuel.

BACKGROUND

Pulverizers are well known for the reduction of the particle size of solid fuel to allow for combustion of the solid fuel in a furnace. A pulverizer employs some combination of impact, attrition and crushing to reduce a solid fuel to a particular particle size. Several types of pulverizer mills can be employed for the pulverization of the solid fuel, for example, coal, to a particulate size appropriate for firing in a furnace. These mills can include ball-tube mills, impact mills, attrition mills, ball race mills, and ring roll or bowl mills. Most typically, however, bowl mills with integral classification equipment are employed for the pulverization of the solid fuel to allow for the transport, drying and direct firing of the pulverized fuel entrained in an air stream.

Bowl mills have a grinding ring carried by a rotating bowl. Fixed position rollers are mounted on roller journal assemblies such that the roll face of the rollers are approximately parallel to the inside surface of the grinding ring and define a very small gap therebetween. Pressure for grinding is applied through springs or hydraulic cylinders on the roller journal to crush solid fuel caught between the roll face of the roller and the grinding ring.

An air stream is typically utilized for drying, classification, and transport of the solid fuel through the pulverizer. The air stream employed is typically a portion of the combustion air referred to as the primary air. The primary air is combustion air first directed through a preheater whereby the combustion air is heated with energy recovered from the flue gas of the furnace. A portion of the primary air is then ducted to the pulverizers. In a bowl mill, the primary air is drawn through beneath the bowl of the bowl mill and up past the roller journal assemblies to collect the pulverized solid fuel. The small particles of solid fuel become entrained in the primary air. The air stream containing the solid fuel then passes through a classifier into the outlet of the pulverizer. After passing through the exhauster, the pulverized fuel can be stored, or more typically, is transported to the furnace by the air stream for direct firing.

For example, U.S. Pat. No. 4,706,900 entitled "Retrofitable Coiled Spring System," which issued on Nov. 17, 1987 and which is assigned to the same assignee as the present invention illustrates a prior art form of bowl mill using a coiled spring assembly for applying pressure on the roller journal to crush solid fuel caught between the roll face of the roller and the grinding ring. U.S. Pat. No. 4,706,900 discloses both the nature of the construction and the mode of operation of a bowl mill that is suitable for use for purposes of effecting the pulverization of the coal that is used to fuel a coal-fired steam generator.

The existing journal loading systems, which dictates the amount of grinding force that the grinding rolls exert on the coal as mentioned above, consist of either a spring only journal loading system or a hydraulic journal loading system. One such arrangement of mechanical spring journal loading system can be found depicted, for example, in U.S. Pat. No. 4,706,900. The spring only journal loading system consists of a spring with an integral threaded shaft that is adjusted manually which thereby changes the spring force applied to the journal. This spring force in turn would increase or decrease the load that the grinding roll imparts on the material being pulverized. Also, one such arrangement of a hydraulic journal loading system can be found depicted, for example, in U.S. Pat. No. 4,372,496. The hydraulic journal loading system incorporates a hydraulic system, which can be adjusted to change the force being applied to the journal in turn increasing or decreasing the load on the grinding roll that is pulverizing the material. The spring only method of adjusting the load on the journal does not provide a means to automatically adjust the force being applied to the journal while the mill is in operation. Further, the hydraulic journal loading system requires a large footprint external to the mill to operate and requires extensive maintenance and expertise to operate the hydraulic system.

Therefore, there remains a need for an apparatus and method for controlling and adjusting the amplitude of the load being applied to a journal assembly of a pulverizing mill. Specifically, an journal loading system is needed which is capable of being electronically controlled or adjusted that overcome the drawbacks of the hydraulic and spring only journal loading systems.

SUMMARY

According to the aspects illustrated herein, there is provided a mill for pulverizing a material. The mill includes a grinding table rotatably mounted on a shaft and a grinding roll rotable via a journal assembly. The journal assembly is supported so as to be pivotable and move the grinding roll into and out of engagement with the material disposed on the grinding table. A journal loading system in communication with the journal assembly applies a spring force to the grinding roll. The journal loading system includes a spring having a first end in communication with the journal assembly that applies the spring force thereto. A preload stud in communication with the spring changes the spring force of the spring in response to rotation of the preload stud. A motor in communication with the preload rod rotates the preload stud in response to a control signal indicative of the desired spring force.

According to the other aspects illustrated herein, there is provided a journal loading system for a pulverizing mill. The journal loading system includes a spring having a first end in communication with a journal assembly that applies a spring force thereto. A preload stud in communication with the spring changes the spring force of the spring in response to rotation of the preload stud. A motor in communication with the preload stud rotates the preload stud in response to a control signal indicative of the desired spring force.

According to yet the other aspects illustrated herein, a method of pulverizing a material is provided that includes applying a spring force via a journal loading system to move a grinding roll via a journal assembly in and out of engagement with a grinding table. The method further includes rotating a preload stud of the journal loading system to engage a spring that provides the spring force, wherein a motor rotates the preload stud in response to a control signal indicative of the desired spring force.

BRIEF DESCRIPTION OF THE DRAWINGS

Referring now to the figures, which are exemplary embodiments, and wherein the like elements are numbered alike.

DETAILED DESCRIPTION

Figure 1:
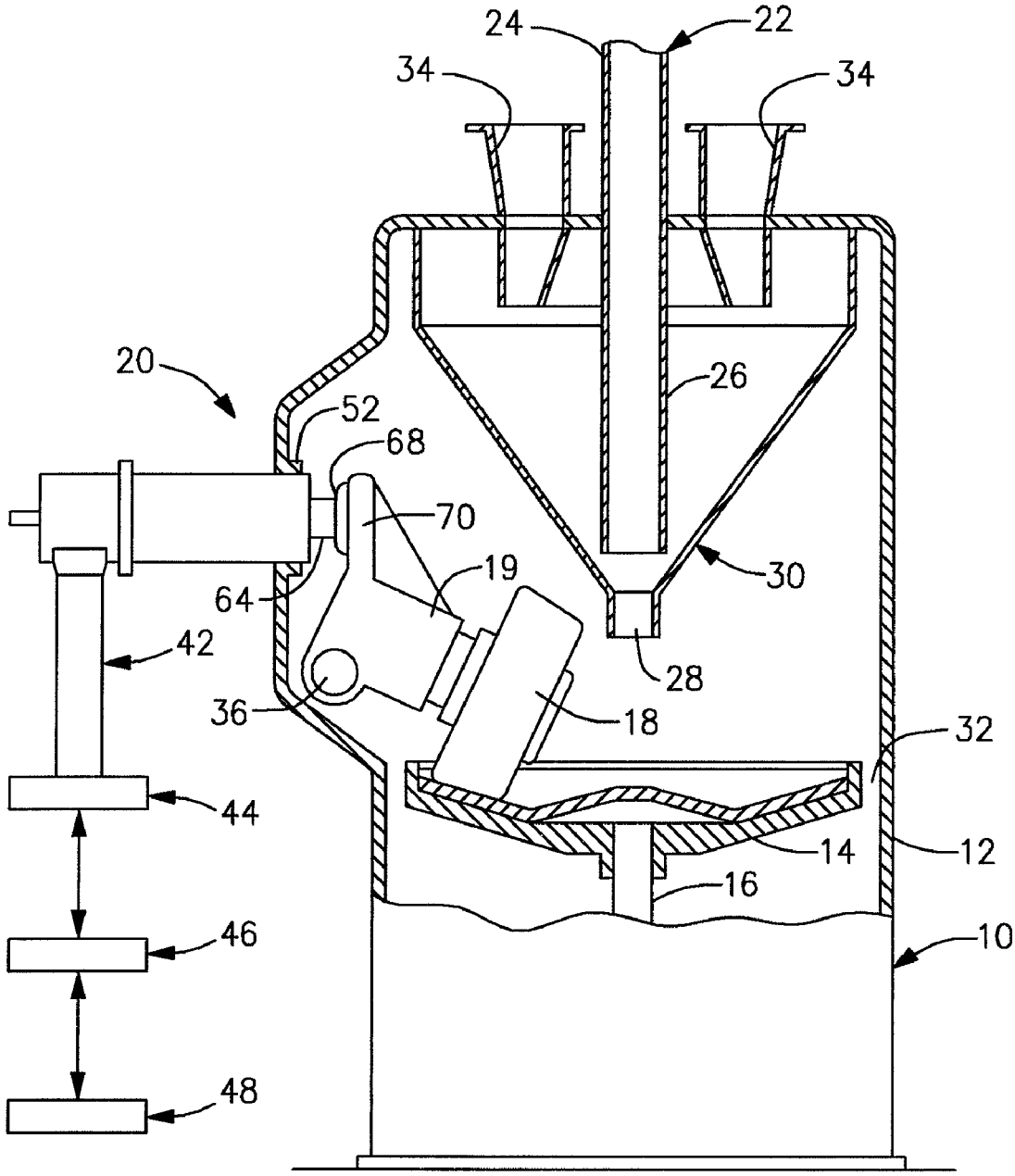
FIG. 1 is a side elevational view partially in section of a pulverizer bowl mill equipped with an electronically controlled journal loading system constructed in accordance with the present invention.

Referring now to the drawings, and more particularly to FIG. 1, a pulverizing bowl mill 10 in accordance with the present invention is shown. As the nature of the construction and the mode of operation of pulverizing bowl mills are well-known to those skilled in the art, it is not deemed necessary, therefore, to set forth herein a detailed description of the pulverizing bowl mill 10 illustrated in FIG. 1 of the drawing. Rather, it is deemed sufficient for purposes of obtaining an understanding of a pulverizing bowl mill 10, which is equipped with an electronically controlled journal loading system constructed in accordance with the present invention, that merely a description of the nature of the construction and the mode of operation of the components of the pulverizing bowl mill 10 with which the electronically controlled journal loading system cooperates. For a more detailed description of the nature of the construction and the mode of operation of the components of the pulverizing bowl mill 10, which are not described in detail herein, reference is made to the prior art, e.g., U.S. Pat. No. 3,465,971, which issued on Sep. 9, 1969 to J. F. Dalenberg et al., and/or U.S. Pat. No. 4,002,299, which issued on Jan. 11, 1977 to C. J. Skalka.

Still referring to FIG. 1, the pulverizing bowl mill 10 includes a substantially closed separator body 12. A grinding table 14 is mounted on a shaft 16, which in turn is operatively connected to a suitable drive mechanism (not shown) so as to be capable of being suitably driven thereby. With the aforesaid components arranged within the separator body 12 in the manner depicted in FIG. 1 of the drawing, the grinding table 14 is designed to be driven in a clockwise direction.

A plurality of grinding rolls 18, preferably three in number in accordance with conventional practice, are suitably supported within the interior of the separator body 12 so as to be equidistantly spaced one from another around the circumference of the separator body 12. In the interest of maintaining clarity of illustration in the drawing, only one grinding roll 18 is shown in FIG. 1. Each of the grinding rolls 18 is supported on a suitable shaft (not shown) of a journal assembly 19 for rotation relative thereto. The grinding rolls 18 are each suitably supported in a manner for movement relative to the upper surface, as viewed with reference to FIG. 1, of the grinding table 14. To this end, each of the grinding rolls 18 has a electronically controlled journal loading system 20, cooperatively associated therewith via the journal assembly 19. Each of the journal loading systems 20 is operative to establish a mechanical spring loading on the corresponding grinding roll 18 to exert the requisite degree of force on the solid fuel disposed on the grinding table 14 for the desired purpose of pulverizing the solid fuel.

The solid fuel material, e.g., coal, which is pulverized in the bowl mill 10 is fed thereto through the use of any suitable conventional type of feeding means such as a belt feeder (not shown). Upon falling free of the belt feeder (not shown), the coal enters the bowl mill 10 from a coal supply means, generally designated by reference numeral 22. The coal supply means 22 includes a suitably dimensioned duct 24 having one end thereof which extends outwardly of the separator body 12 and preferably terminates in a funnel-like member (not shown). The latter funnel-like member (not shown) is shaped to facilitate the collection of the coal particles leaving the belt feeder (not shown), and to guide the coal particles into the duct 24. The other end 26 of the duct 24 of the coal supply means 22 is operative to effect the discharge of the coal onto the surface of the grinding table 14. As shown in FIG. 1, the duct end 26 is supported within the separator body 12 such that the duct end 26 is coaxially aligned with the shaft 16, and is located in spaced relation to an outlet 28 provided in a classifier 30, through which the coal flows in the course of being fed onto the surface of the grinding table 14.

A gas such as air is used to convey the finer ground coal from the grinding table 14 through the interior of the separator body 12 for discharge from the pulverizing bowl mill 10. The air enters the separator body 12 through a suitable opening (not shown) provided therein for this purpose. The air flows to a plurality of annular spaces 32 from the aforesaid opening (not shown) in the separator body 12. The plurality of annular spaces 32 are formed between the circumference of the grinding table 14 and the inner wall surface of the separator body 12. The air upon exiting from the annular spaces 32 is deflected over the grinding table 14 by means of suitably positioned deflector means (not shown). One such form of deflector means (not shown), which is suitable for this purpose in the bowl mill 10 of FIG. 1, comprises the subject matter of U.S. Pat. No. 4,234,132, which issued on Nov. 18, 1980 to T. V. Maliszewski, Jr., and which is assigned to the same assignee as the present application.

While the air is flowing along the path described above, the coal disposed on the surface of the grinding table 14 is pulverized by the grinding rolls 18. As the coal becomes pulverized, the particles are thrown outwardly by centrifugal force away from the center of the grinding table 14. Upon reaching the peripheral circumferential area of the grinding table 14, the coal particles are picked up by the air exiting from the annular spaces 32 and are carried along therewith. The combined flow of air and coal particles is thereafter captured by the deflector means (not shown). The deflector means causes the combined flow of air and coal particles to be deflected over the grinding table 14. In the course of effecting a change in direction in the path of flow of this combined stream of air and coal particles to be deflected over the grinding table 14, the heaviest coal particles, because they have more inertia, become separated from the airstream and fall back onto the grinding table 14 whereupon they undergo further pulverization. The lighter coal particles, on the other hand, because they have less inertia continue to be carried along in the airstream.

After leaving the influence of the aforesaid deflector means (not shown) the combined stream of air and remaining coal particles flow to the classifier 30. The classifier 30, in accord with conventional practice and well-known to those skilled in the art, further sorts the coal particles that remain in the airstream. Namely, those particles of pulverized coal, which are of the desired particle size, pass through the classifier 30 and along with the air are discharged from the bowl mill 10 through the outlets 34. However, the coal particles having a size larger than desired are returned to the surface of the grinding table 14 whereupon they undergo further pulverization. Thereafter, these coal particles are subject to repetition of the process described above. That is, the particles are thrown radially outwardly of the grinding table 14, are picked up by the air exiting from the annular spaces 32, are carried along with the air to the deflector means (not shown), are deflected back over the grinding table 14 by the deflector means (not shown), the heavier particles drop back on the grinding table 14, the lighter particles are carried along to the classifier 30, those particles which are of the proper size pass through the classifier 30 and exit from the bowl mill 10 through the outlets 34.

The amount of force that must be exerted by the grinding rolls 18 in order to effect the desired degree of pulverization of the coal will vary depending on a number of factors. In other words, the amount of force that the grinding rolls 18 must exert in order to accomplish the desired pulverization of the coal is principally a function of the amount, e.g., depth, of coal present on the grinding table 14. In turn, the amount of coal which is disposed on the grinding table 14 is a function of the output rate at which the bowl mill 10 is being operated to produce pulverized coal.

The amount of grinding force which the grinding rolls 18 apply to the coal on the grinding table 14 is a function of the amount of force with which the grinding rolls 18 are biased into engagement with the coal on the table 14. The grinding roll 18 is supported so as to be pivotable about a pivot pin 36 into and out of engagement with the coal disposed on the grinding table 14. Although only one grinding roll 18 is shown in FIG. 1 and although this discussion is directed to one grinding roll 18, it is to be understood that the bowl mill 10 commonly is provided with a plurality of grinding rolls 18, e.g., preferably three in number, and that this discussion is equally applicable to each of the plurality of grinding rolls 18.

The grinding roll 18 is designed to be biased by a spring force into and out of engagement with the coal on the grinding table 14. More specifically, the spring force applied to the grinding roll 18 is applied by the electronically controlled journal loading system 20. That is, in accord with the best mode embodiment of the invention each of the three grinding rolls 18 with which the bowl mill 10 is provided has cooperatively associated therewith a new and improved electronically controlled journal loading system 20. However, inasmuch as the three electronically controlled journal loading systems 20 are each identical in construction and in mode of operation, it has been deemed sufficient for purposes of obtaining an understanding thereof as well as in the interest of maintaining clarity of illustration in the drawing to show only one of the three journal loading systems 20 in FIG. 1.

The journal loading system 20 in accordance with the present invention that controls and adjusts the amplitude of the load applied to the journal assembly 19 of the pulverizing mill 10. The journal loading system 20 consists of a coiled spring assembly 40, a gearbox 42, a motor 44, a controller 46, and a user interface 48. The journal loading system 20 provides electronic control and adjustment of the force applied to the journal assembly 19 thereby increasing or decreasing the load that the grinding roll 18 imposes on the material being pulverized.

The coiled spring assembly 40 includes a threaded spring preload stud 50 configured to extend substantially the entire length of the coiled spring assembly. The preload stud 50 is disposed within a tubular housing 52. With the outer end 54 of the preload stud 50 positioned within the housing 52 of the coiled spring assembly 40 in the manner depicted in FIG. 2, the outer end 54 of the preload stud protrudes outwardly from the housing to thereby engage the gearbox 42, such as a vertical gearbox as shown.

Figure 2:
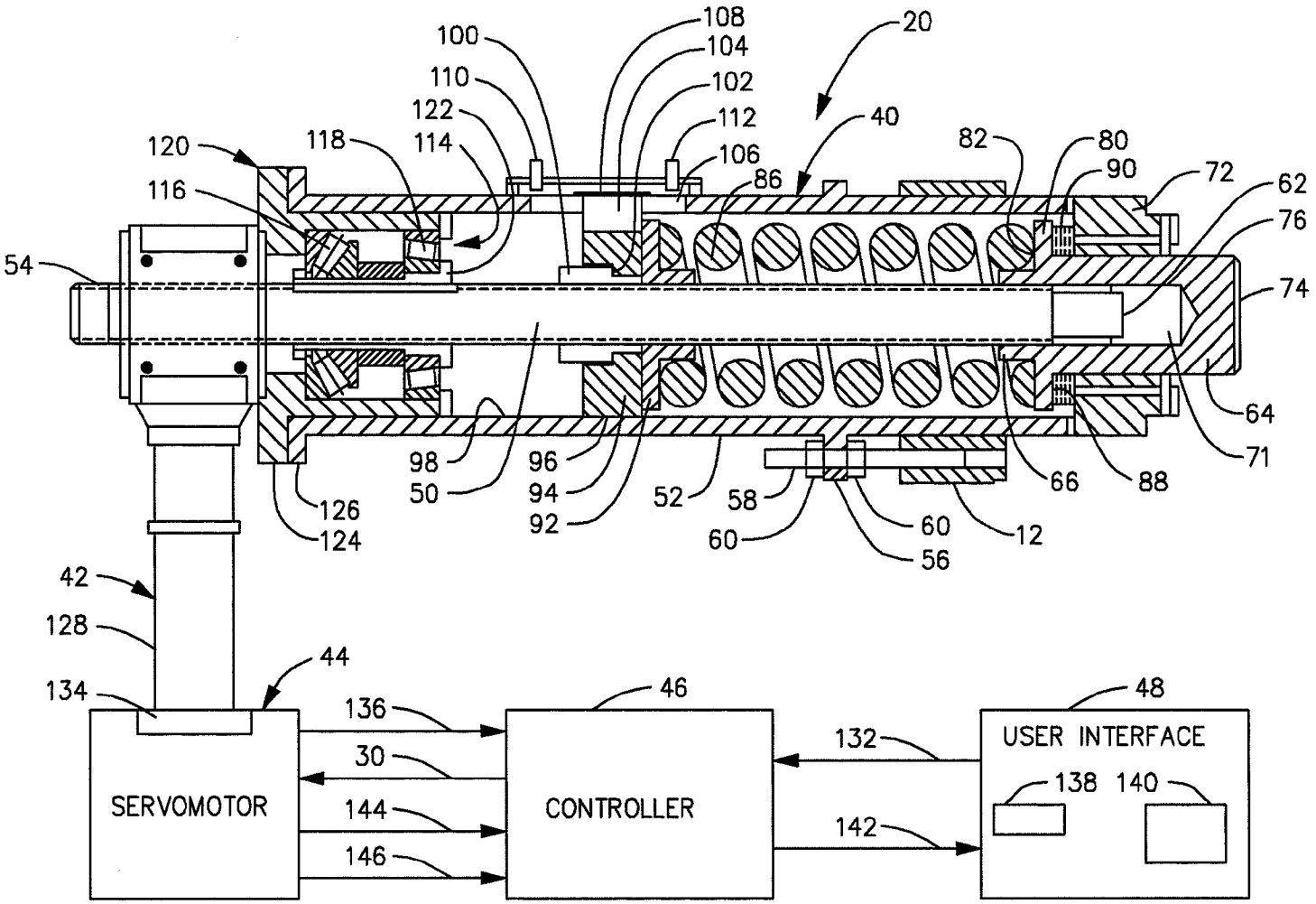
FIG. 2 is a schematic view of an electronically controlled journal loading system further illustrating an enlarged cross-sectional view of the electronically controlled journal loading system of the pulverizer bowl mill of FIG. 1 constructed in accordance with the present invention.

As best shown in FIGS. 1 and 2, the housing 52 includes an annular flange 56 disposed intermediate of the ends of the spring assembly 40 for mounting the spring assembly to the wall 12 of the mill 20. The annular flange is adjustably attached to the mill wall 12 by a plurality of threaded studs 58 wherein one end thereof threadably engages the mill wall and the other end engages the flange 56 of the housing through holes disposed therein. The flange 56 is secured to the threaded studs by a pair of threaded fasteners 60.

An inner end 62 of the spring preload stud 50, such as a bronze guide bushing, is disposed within an engagement seat 64 for contacting the journal arm 19. As shown, the preload stud 50 extends into a bore 71 disposed in the inner end 66 of the engagement seat 64. The engagement seat is slidably secured to the housing 52 by an end cap 72 attached to the housing, such that the engagement seat 64 projects through and from the end cap a selectable distance. The outer end 76 of the engagement seat 64 is generally cylindrical having a flat engagement surface 74. A radial flange 80 extends circumferentially around the inner end 66 of the engagement seat recessed a predetermined distance from the inner end. The inner surface 82 of the flange 80 provides a spring seat for one end of the coil spring 86, while the outer surface 88 of the flange provides a seat for one end of a cushioned buffer 90. The end cap 72 of the housing provides another seat for the other end of the cushioned buffer 90. The coil spring 86 provides the necessary spring force on the engagement seat for urging the journal assembly 19 and roll 18 in contact with the bed of material to be ground, which is disposed on the grinding table 14.

The other end of the coil spring 86 engages a generally L-shaped, annular seat 92 disposed slidably on the preload stud 50. The annular seat is movably supported by an annular bushing 94. The outer surface 96 of the bushing 94 slidably engages the inner surface 92 of the housing 52. The axial movement of the annular bushing 94 and hence, the compression or decompression of the coil spring 86 is provided by a nut 100 threadably engaging the threaded stud 50. The nut is disposed partially within the bushing 94 and engages the bushing at an inner annular wall 102. As will be described in greater detail hereinafter, as the preload stud 50 is rotated the nut 100 travels axially along the stud to compress or decompress the coil spring 86 to provide a desired compressive force to the engagement seat 64. In one exemplar embodiment, the nut 100 is formed of a metallic material, such as bronze.

As shown in FIG. 2, a portion 104 of the bushing 94 extends radially through an opening or slot 106 in the housing 52. A contact plate 108 is disposed on the extended portion 104 of the bushing 94. The contact plate 108 is positioned to contact a pair of contact switches 110, 112 mounted to the housing 52 above the opening 106 in the housing 52. As the plate 108 translates laterally along the opening 106 in conjunction with the movement of the bushing 94 and nut 100, the plate contacts one of the contact switches 110, 112. The outer switch 110 provides an electrical signal indicative of a minimum or initial position of the bushing, and the inner switch 112 provides a signal indicative of a maximum or end position of the bushing 94.

The outer end 54 of the preload stud 50 is supported within the housing 52 by a bearing assembly 114 including a thrust bearing 116 and a taper roller bearing 118. The bearing assembly 114 includes an annular, outer bearing support 120 and an annular, inner bearing support 122 for maintaining the bearings in fixed support of the preload stud. The outer bearing support 120 includes a flanged end 124 that engages a flanged end 126 of the housing 52 to position the bearing assembly 114 at a predetermined location on the preload stud 50.

The vertical gearbox 42, commonly known in the art, engages the outer end 54 of the preload stud 50 extending from the coiled spring assembly 40. A vertical shaft 128 of the gearbox rotates, whereby the rotation of the shaft translates to the rotation of the preload stud 50. In response to a control signal 130 from a controller or processor 46, a motor 44, such as a brushless servo motor, operates for a selected time period or turns a selected number of times to rotate the preload stud 50, and thus translate the nut 100 and bushing 94 to compress or decompress the coil spring 86 to provide a desired spring force on the engagement seat 64, which provides the desired force of the roll 18 onto the grinding table 14. The servomotor 44 may be operated in a closed loop configuration wherein a sensor 134 provides a signal indicative of the radial position of the drive shaft of the motor. Such a sensor 134 includes a resolver, whereby the resolver measures the rotational position of the drive shaft or rotor of the servomotor 44.

The controller 46 provides the control signal 130 to the servomotor 44 to compress or decompress the coil spring 86 of the coil spring assembly 40 in response to a user input signal 132 indicative of the desired compression of the coil spring or the desired compression force applied by the engagement seat 64 to the journal head 70. The resolver 134 provides a signal 136 indicative of the position of the nut 100 and bushing 94 along the preload stub 50. Knowing the characteristic of the coil spring, such as compression characteristics and dimensions, the applied compressive force by the engagement seat 64 to the journal head 70 may be determined. The position and/or compression force may be displayed to a user by a numerical display 138 or display monitor 140 disposed on or in connection with the user interface 48 in response to a signal 142 provided by the controller 46. The user may, in response to the displayed value, actuate a switch (not shown) to provide a control signal 132 to increase or decrease the compression of the coil spring 86. Once the compression of the coil spring 86 is set, the position of the nut 100 will remain in the position set by the user until changed. The servo journal loading system 20 thus eliminates hand adjustment of the spring force by incorporating an electronic human push button interface to change the loading of the journal assembly 19. In the alternative, the user may input via the user interface 48, such as a keyboard and switches, a desired journal load setting, whereby the controller provides a control signal 132 to adjust the compressive force accordingly.

By employing a brushless servomotor 44 with resolver 134 along with a high ratio gearbox 42 and digital readout 138, the force applied to the journal assembly 19 can be incrementally adjusted to suite the pulverizing demands while the mill 10 is in operation. Also, the servo journal loading controller 46 and user interface 48 allows the user to build predefined journal loading levels that can be selected and entered through the operator interface 48. This new servo loading system 20 eliminates the use of hydraulics and reduces the wear and tear on the gearbox 42 and servomotor 44 due to the servo screw 86 and gearbox being independent of the forces being applied by the journal assembly 19 and spring assembly 86. When compared to a hydraulic journal loading system, the servo journal loading system 20 is less expensive, requires less maintenance, and provides predefined load settings selectable through the operator interface 48.

While a separate controller 46 and user interface 48 are illustrate as separate components, the present invention contemplates that these components may be combined into a single components, such as a computer or a plant's digital control system (DCS). Further while a resolver is described to provide a feedback signal indicative of the position of the nut 100 and bushing 94 along the preload stub 50, one will appreciate that any device that can provide a feedback position may be used, such as an encoder or displacement transducer.

As described hereinbefore the contact switches 110, 112 provide respective position signals 144, 146 indicative of the minimum and maximum position, respectively, of the nut 100 and bushing 94. In response to the actuation of a contact switch 110, 112, the controller 46 will limit the movement of the nut and bushing such that the nut and bushing do not translate beyond the travel limits defined by the control switches.

There will now be set forth a description of the mode of operation of the electronically controlled servo journal load system 20, which forms the subject matter of the present invention, in the context of the operation of the mill 10. In the mode of operation of the servo journal loading system 20, a predefined or desired load set point is selected via the user/operator interface 48. Alternatively, the journal loading can be increased or decreased by pressing a button or switch, which generates a control signal to corresponding increase or decrease the compression of the coil spring 86. The servomotor 44 rotates a preload stud (or servo screw) 50 within the coiled spring assembly 40 in the appropriate direction via a high ratio gearbox. As the preload stud 50 turns, the bronze nut 100 and bushing 94 moves axially along the stud to compress or decompress the spring 86. Based upon the linear movement of the preload stud 50 and the precalculated spring force of the spring 86, the load applied to the journal assembly 19 is displayed on the operator interface 48. Once the journal loading level is achieved the servomotor 44 can be turned off since the spring assembly 40 maintains the selected loading to the journal assembly 19.

One will appreciate that the present invention is applicable to any type of pendulum type of mills having a vertical grinding ring and grinding rolls, which includes Raymond® Roller Mill and mills from other manufacturers with similar designs. Further, one will appreciate that the present invention is applicable any type of table mill that requires hydraulic or springs to set roll pressure. The present invention may also be used to grind a large variety of materials, such as limestone, clays, gypsum, and phosphate rock among others.

The present invention further contemplates the spring deflection of each journal loading system 20 of the mill 10 may be monitored and then selectively adjusted electronically the spring preload such that the spring deflection of each journal loading systems in the mill 10 is approximately the same to maintain the grinding forces substantially equal and balanced to thereby reduce the bending moment of the main mill shaft. Furthermore, the journal loading system(s) 20 may be adjusted electronically in response to a vibration monitor, which measures the mill's vibration level. In response to the vibration monitor, the journal loading systems 20 are electronically controlled to reduce and balance the grinding forces to reduce destructive vibrations.

While the invention has been described with reference to various exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A mill for pulverizing a material, the mill comprising:

a grinding table rotatably mounted on a shaft;

a grinding roll rotatable via a journal assembly, the journal assembly being supported so as to be pivotable and move the grinding roll into and out of engagement with the material disposed on the grinding table; and a journal loading system in communication with the journal assembly to apply a spring force to the grinding roll, the journal loading system including:

a spring having a first end in communication with the journal assembly that applies the spring force thereto;

a preload stud in communication with the spring that changes the spring force of the spring in response to rotation of the preload stud; and a motor in communication with the preload stud that rotates the preload stud in response to a control signal indicative of the desired spring force.

2. The mill of claim 1 further comprising a spring adjustment nut assembly threadably engaging the preload stud, wherein the spring nut assembly engages the spring and translates along the preload stud to change the spring load in response to the rotation of the preload stud.

3. The mill of claim 1 further comprising a resolver that provides a signal indication of the angular position of the preload stud.

4. The mill of claim 1 further comprising a sensor indicative of the position of the spring adjustment nut assembly.

5. The mill of claim 1 further comprising a controller that determines a parameter indicative of the spring force.

6. The mill of claim 1 further comprising a user interface to enable a user to select the desired spring force.

7. The mill of claim 1 further comprising a controller that provides the control signal in response to a user input.

8. The mill of claim 1 further comprising a sensor that provides a signal indicative of a desired minimum and/or maximum position of the spring adjustment nut assembly.

9. A journal loading system for a pulverizing mill, the journal loading system comprising:

a spring extending in an axial direction having a first end in communication with a journal assembly that applies a spring force thereto;

a preload stud that changes its length in the axial direction in response to rotation of a portion of the preload stud, the preload stud being in communication with the spring thereby changing the spring force of the spring on the journal assembly; and a motor in communication with the preload stud that screws in or out a portion of the preload stud changing its length in the axial direction in response to a control signal indicative of the desired spring force.

10. The journal loading system of claim 9 further comprising a spring adjustment nut assembly threadably engaging the preload stud, wherein the spring nut assembly engages the spring and translates along the preload stud to change the spring load in response to the rotation of the preload stud.

11. The journal loading system of claim 9 further comprising a thrust bearing and a tapered bearing rotatably supporting a portion of the preload stud.

12. The journal loading system of claim 9 further comprising a vertical gearbox engaging one end of the preload and the motor to rotate the preload stud in response to the operation of the motor.

13. The journal loading system of claim 9 further comprising a resolver that provides a signal indication of the angular position of the preload stud.

14. The journal loading system of claim 9 further comprising a position sensor indicative of the position of the spring adjustment nut assembly.

15. The journal loading system of claim 9, wherein the motor includes a servomotor that provides a signal indicative of the rotational position of a drive shaft of the motor.

16. The journal loading system of claim 9 further comprising a controller that determines a parameter indicative of the spring force.

17. The journal loading system of claim 9 further comprising a user interface to enable a user to select the desired spring force.

18. The journal loading system of claim 9 further comprising a controller that provides the control signal in response to a user input.

19. The journal loading system of claim 9 further comprising a sensor that provides a signal indicative of a desired minimum and/or maximum position of the spring adjustment nut assembly.

20. A method of pulverizing a material, the method comprising:

applying a spring force in an axial direction via a journal loading system to move a grinding roll via a journal assembly in and out of engagement with a grinding table;

screwing a portion of the preload stud into or out of the preload stud causing the preload stud to increase or decrease its length in an axial direction to engage a spring that provides the spring force, wherein a motor rotates the portion of the preload stud in response to a control signal indicative of the desired spring force.

* * * * *